US005983775A

United States Patent [19]

Fukai

[11] Patent Number: 5,983,775

[45] Date of Patent: Nov. 16, 1999

[54] SWASH-PLATE COMPRESSOR IN WHICH IMPROVEMENT IS MADE AS REGARDS A CONNECTION MECHANISM BETWEEN A PISTON AND A SWASH PLATE

[75] Inventor: Isamu Fukai, Fujioka, Japan

[73] Assignee: Sanden Corporation, Gunma, Japan

[21] Appl. No.: 09/003,876

[22] Filed: Jan. 7, 1998

[30] Foreign Application Priority Data

Jan. 9, 1997 [JP] Japan ..... 9-001799

[51] Int. Cl.[6] ..... F01B 3/00

[52] U.S. Cl. ..... 92/12.2; 92/71

[58] Field of Search ..... 92/12.2, 57, 71; 91/505

[56] References Cited

U.S. PATENT DOCUMENTS

| | | | |
|---|---|---|---|
| 1,517,386 | 12/1924 | Almen | 92/71 X |
| 2,335,415 | 11/1943 | Holmes . | |
| 3,010,403 | 11/1961 | Zubaty | 92/12.2 X |
| 4,664,604 | 5/1987 | Terauchi | 417/222 |
| 4,979,877 | 12/1990 | Shimizu . | |
| 5,063,829 | 11/1991 | Takao et al. | 92/71 |
| 5,140,903 | 8/1992 | Terauchi . | |
| 5,269,193 | 12/1993 | Rabinow | 91/71 X |
| 5,316,446 | 5/1994 | Kimura et al. | 92/12.2 X |
| 5,540,559 | 7/1996 | Kimura et al. | 92/12.2 X |
| 5,644,968 | 7/1997 | Kimura et al. | 92/12.2 |
| 5,699,716 | 12/1997 | Ota et al. | 92/12.2 |
| 5,839,347 | 11/1998 | Nomura et al. | 92/12.2 |

FOREIGN PATENT DOCUMENTS

| | | |
|---|---|---|
| 0280479 | 8/1988 | European Pat. Off. . |
| 911137 | 1/1945 | France . |
| 2397545 | 2/1979 | France . |
| 261627 | 12/1990 | Japan . |

*Primary Examiner*—John Ryznic
*Attorney, Agent, or Firm*—Baker & Botts LLP

[57] ABSTRACT

In a swash-plate compressor wherein a piston (23 ) is connected through a connection mechanism to a swash plate (34) supported on a drive shaft (26), the swash plate is rotatable relative to the drive shaft around a predetermined axis extending in a given direction. The piston has a drive end portion (36) having a concave surface (37) defining a recessed portion. The swash plate is provided with a flat portion (38) loosely inserted in the recessed portion. Between the concave surface and said flat portion in the given direction, a sliding member (38*a* or 38*b*) is held to be slidable along the concave surface and the flat portion. A combination of the drive end portion, the flat portion, and the sliding member is referred to as the connection mechanism.

7 Claims, 2 Drawing Sheets

SWASH-PLATE COMPRESSOR IN WHICH IMPROVEMENT IS MADE AS REGARDS A CONNECTION MECHANISM BETWEEN A PISTON AND A SWASH PLATE

BACKGROUND OF THE INVENTION

This invention relates to a swash-plate compressor and, in particular, to a connection mechanism between a piston and a swash plate which are included in the swash-plate compressor.

Generally, a swash-plate compressor comprises a drive shaft, a swash plate coupled to the drive shaft, and a plurality of pistons operatively coupled to the swash plate. When the drive shaft is rotated by a drive unit in the manner known in the art, the swash plate has a motion which in turn causes a reciprocating motion of each piston within a cylinder bore. Broadly, the swash-plate compressor includes two different types which will hereafter be described as first and second conventional swash-plate compressors.

The first conventional swash-plate compressor is described, for example, in Japanese Patent Publication (JP-B) No. 61627/1990 and has a structure in which the swash plate is fixedly and integrally supported on the drive shaft so as to rotate together with the drive shaft. In other words, the swash plate is unrotatable relative to the drive shaft. The swash plate is slidably coupled to the pistons in an axial direction of the drive shaft. During operation of the first conventional swash-plate compressor, the pistons simply perform the reciprocating motion while the swash plate is rotated together with the drive shaft. This causes a high-speed sliding motion between each piston and the swash plate. It is therefore required to take a fully effective countermeasure against the above-mentioned high-speed sliding motion.

On the other hand, the second conventional swash-plate compressor has a structure in which the swash plate is coupled to the drive shaft so as to perform the swinging motion alone without being rotated together with the drive shaft. In other words, the swash plate is rotatable relative to the drive shaft. When the drive shaft is rotated by the drive unit, the swash plate has a swinging motion which is then converted into the reciprocating motion of each piston.

In the second conventional swash-plate compressor which will later be described in detail in conjunction with the drawing, the swash plate is connected to each piston via a piston rod. Therefore, a rotation stopper mechanism is essential for stopping a rotation of the swash plate as is well known in the art, so that the compressor is complicated in structure. In addition, it is difficult to arrange the rotation stopper mechanism concentrically with the drive shaft. Generally, the rotation stopper mechanism is arranged at a particular position in the vicinity of the periphery of the swash plate. With this structure, the swinging motion of the swash plate inevitably becomes nonuniform or unbalanced. Specifically, loci of the swinging motion are different at those points which are equally spaced from the center of the swinging motion but are near to and apart from the rotation stopper mechanism. This may result in occurrence of vibration and noise.

SUMMARY OF THE INVENTION

It is therefore an object of this invention to provide a swash-plate compressor in which improvement is made as regards a connection mechanism between a piston and a swash plate.

It is another object of this invention to provide a swash-plate compressor of the type described, in which the swash plate is substantially kept unrotatable without any special rotation stopper mechanism to thereby achieve a simple structure as well as suppression of vibration and noise.

Other objects of this invention will become clear as the description proceeds.

A swash-plate compressor to which this invention is applicable comprises a drive shaft, a swash plate placed concentric with the drive shaft, a support mechanism supporting the swash plate on the drive shaft so that the swash plate is rotatable relative to the drive shaft around a predetermined axis extending in a given direction, a piston, and a connection mechanism connecting the piston to the swash plate. In the swash-plate compressor, the connection mechanism comprises a drive end portion connected to the piston and having a concave surface defining a recessed portion, a flat portion connected to the swash plate and loosely inserted in the recessed portion, and a sliding member held between the concave surface and the flat portion in the given direction to be slidable along the concave surface and the flat portion.

DETAILED DESCRIPTION OF THE DRAWING

Figure 1:
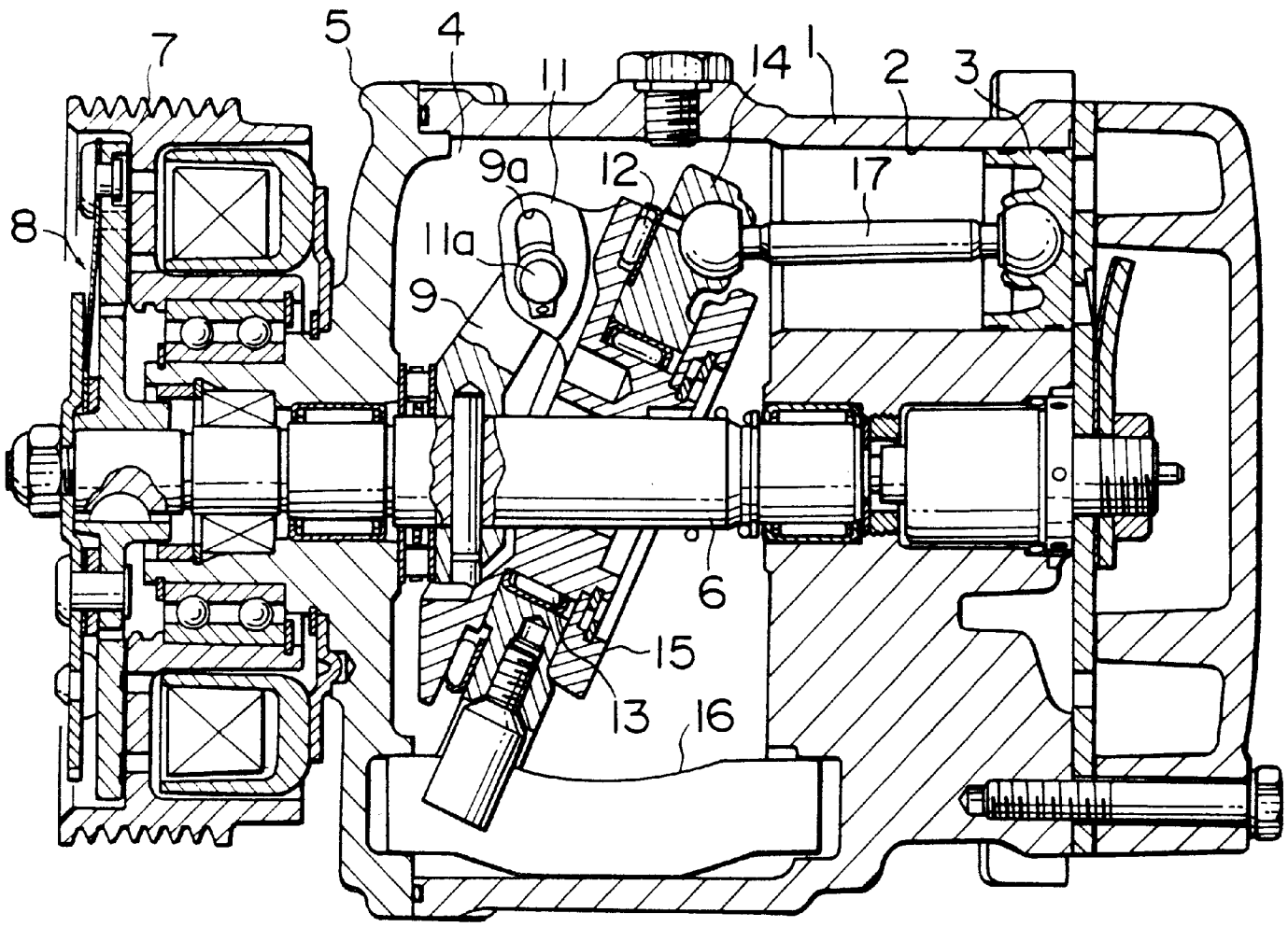
FIG. 1 PRIOR ART
FIG. 1 is a vertical sectional view of a conventional swash-plate compressor of a variable displacement type.

In order to facilitate an understanding of this invention, a conventional swash-plate compressor, which has been mentioned above as the second conventional swash-plate compressor, will at first be described with reference to the drawing.

Referring to FIG. 1, the conventional swash-plate compressor illustrated in the figure is of a variable-displacement type known in the art. The conventional swash-plate compressor comprises a cylinder block 1 having a plurality of cylinder bores 2 (only one being illustrated in the figure). The cylinder bores 2 are arranged parallel to one another around a center axis of the cylinder block 1. A plurality of pistons 3 are inserted into the cylinder bores 2, respectively. Each of the pistons 3 is slidable along each of the cylinder bores 2. In front of the cylinder block 1, a crank chamber 4 is formed to have a front end closed by a front housing 5. A drive shaft 6 extends along the center axis of the cylinder block 1 and penetrates the front housing 5. The drive shaft 6 has one end operatively coupled to an external pulley 7 via an electromagnetic clutch 8 which serves to permit and inhibit transmission of rotation force of the external pulley 7 to the one end of the drive shaft 6. The other end of the drive shaft 6 is supported by the cylinder block 1.

Within the crank chamber 4, a fixed hinge 9 is fixed to the drive shaft 6 to be unrotatable relative to the drive shaft 6. The fixed hinge 9 is coupled to a variable angle hinge 11. Specifically, the fixed hinge 9 has an elongated hole 9*a* engaged with a pin 11*a* of the variable angle hinge 11. Thus, the pin 11*a* is movable within the elongated hole 9*a* to vary an angle of the variable angle hinge 11 with respect to the drive shaft 6. To the variable angle hinge 11, a swash plate 14 is supported through a thrust needle bearing 12 and a radial needle bearing 13 to be rotatable around a central axis thereof relative to the drive shaft 6. In addition, the swash plate 14 is inhibited by a release preventing mechanism 15 from being released. The swash plate 14 is prevented by a rotation stopper mechanism 16 from being rotated together with the drive shaft 6.

Following the rotary motion of the drive shaft 6, the fixed hinge 9 and the variable angle hinge 11 are rotated together with the drive shaft 6. In this event, the swash plate 14 performs a swinging motion or a wobbling motion without being rotated together with the drive shaft 6. In this connection, the swash plate 14 may be called a wobble plate.

The swash plate 14 is connected at its periphery to each piston 3 through a piston rod 17 which is connected to the piston 3 and the swash plate 14 through ball joints at one end and the other end, respectively.

In the conventional swash-plate compressor, the swash plate 14 is not rotated together with the rotary shaft 6. Therefore, the sliding motion at the junctions between the swash plate 14 and the piston rod 17 and between the piston rod 17 and the piston 3 has a low speed. Under the circumstances, the sliding motion at these junctions does not cause a serious problem. However, the conventional swash-plate compressor has several problems described before.

Figure 2:
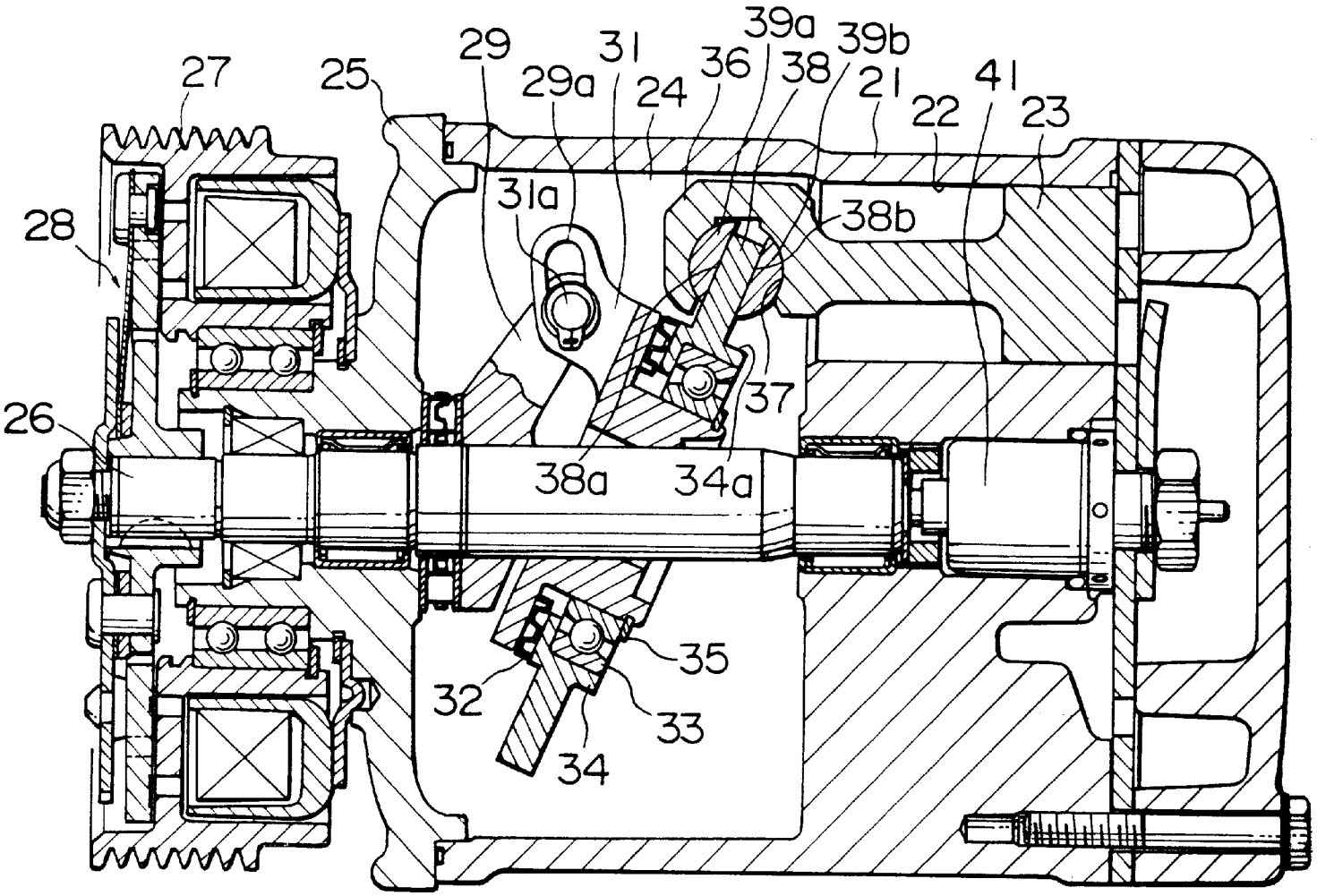
FIG. 2 is a vertical sectional view of a swash-plate compressor of a variable displacement type according to an embodiment of this invention.

Referring to FIG. 2, description will be made about a swash-plate compressor according to an embodiment of this invention. The swash-plate compressor is of the variable displacement type and comprises a cylinder block 21 having a plurality of cylinder bores 22 (only one being illustrated in the figure). The cylinder bores 22 are arranged parallel to one another around a center axis of the cylinder block 21. A plurality of pistons 23 are inserted into the cylinder bores 22, respectively. Each of the pistons 23 is slidable along each of the cylinder bores 22. In front of the cylinder block 21, a crank chamber 24 is formed to have a front end closed by a front housing 25. A drive shaft 26 extends along the center axis of the cylinder block 1 and penetrates the front housing 25. The drive shaft 26 has one end operatively coupled to an external pulley 27 via an electromagnetic clutch 28 which serves to permit and inhibit transmission of rotation force of the external pulley 27 to the one end of the drive shaft 26. The other end of the drive shaft 26 is supported by the cylinder block 21.

Within the crank chamber 24, a fixed hinge 29 is fixed to the drive shaft 26 to be unrotatable relative to the drive shaft 26. The fixed hinge 29 is coupled to a variable angle hinge 31. Specifically, the fixed hinge 29 has an elongated hole 29*a* engaged with a pin 31*a* of the variable angle hinge 31. Thus, the pin 11*a* is movable within the elongated hole 29*a* to vary an angle of the variable angle hinge 11 with respect to the drive shaft 26. To the variable angle hinge 31, a swash plate 34 is supported through a thrust roller bearing 32 and an angular ball bearing 33 to be rotatable relative to the drive shaft 26 around a predetermined axis extending in a given direction. A reference numeral 35 represents a snap ring. Herein, a combination of the fixed hinge 29 and the variable angle hinge 31 will be referred to as a rotor arrangement with a hinge mechanism. A combination of the thrust roller bearing 32 and the angular ball bearing 33 will be referred to as a bearing arrangement. A combination of the rotor arrangement and the bearing arrangement is referred to as a support mechanism.

Each piston 23 has a drive end portion 36 frontwardly extending into the crank chamber 24. The drive end portion 36 has a spherical concave surface 37 defining a concave or recessed portion.

On the other hand, the swash plate 34 has a peripheral surface 34*a* circularly extending around the predetermined axis. A flat portion 38 protrudes outwardly from the peripheral surface 34*a* of the swash plate 34 to form a ring-shaped flange. The flat portion 38 has two parallel planes 38*a* and 38*b* opposite to each other in the given direction.

The flat portion 38 is inserted into the recessed portion of the drive end portion 36 together with a pair of shoes 39*a* and 39*b*. Each of the shoes 39*a* and 39*b* is interposed between the spherical concave surface 37 and each of the parallel planes 38*a* and 38*b* of the flat portion 38 to be kept in substantially tight contact. Each of the shoes 39*a* and 39*b* is referred to as a sliding member.

In this manner, the piston 23 is coupled to the swash plate 34. A combination of the drive end portion 36, the flat portion 38, and the shoes 39*a* and 39*b* is referred to as a connection mechanism.

Each of the shoes 39*a* and 39*b* has one surface confronting the spherical concave surface 37 and the other surface confronting each of the parallel planes 38*a* and 38*b* of the flat portion 38. The one surface of each of the shoes 39*a* and 39*b* is a spherical surface equal in curvature to the spherical concave surface 37. The other surface is a flat surface. Within the crank chamber 24, a lubricating oil is accumulated and a blowby gas is filled during the operation of the compressor. An internal pressure of the crank chamber 24 is controlled by a pressure control valve 41.

Following a rotary motion of the drive shaft 26, the fixed hinge 29 and the variable angle hinge 31 are rotated together with the drive shaft 26. When the variable angle hinge 31 is rotated together with the drive shaft 26, the swash plate 34 is driven in accordance with an angle of the variable angle hinge 31 with respect to the drive shaft 26. In this event, frictional force between the swash plate 34 and the shoes 39*a* and 39*b* suppresses occurrence of a rotary motion of the swash plate 34. Therefore, the swash plate 34 performs a swinging motion or a wobbling motion alone and is substantially completely inhibited from being rotated together with the drive shaft 26. In this connection, the swash plate 34 may be called the wobble plate. Following the swinging motion of the swash plate 34, each of the pistons 23 performs a reciprocating motion within each of the cylinder bores 22. Thus, an effect similar to that of the conventional swash-plate compressor is achieved.

When the swash plate 34 performs the swinging motion as described above, the flat portion 38 slides along the shoes 39*a* and 39*b* in a radial direction of the swash plate 34. Simultaneously, the shoes 39*a* and 39*b* slide along the spherical surface of the recessed portion 37. Since each sliding motion has a relatively low speed, each of the shoes 39*a* and 39*b* and those portions sliding therealong suffers no substantial abrasion due to the sliding motion in the radial direction.

It is noted here that the swash plate 34 is not strictly inhibited from being rotated. Sometimes, the swash plate 34 may be driven in a rotating direction while performing the swinging motion. Even in such an event, a rotary motion of the swash plate 34 is well suppressed by the frictional force between the swash plate 34 and the shoes 39*a* and 39*b*, and therefore has an extremely low speed. Again, no substantial abrasion will occur due to the sliding motion between the swash plate 34 and the shoes 39*a* and 39*b*. Therefore, no special mechanism is required in order to inhibit the rotary motion of the swash plate 34.

In the swash-plate compressor of a variable-displacement type described above, the variable angle hinge 31 is responsive to variation of the internal pressure within the crank chamber 24 to vary its angle with respect to the drive shaft 26. If the angle of the variable angle hinge 31 is varied, the swash plate 34 is changed in its inclination angle with respect to the drive shaft 26 so that each of the pistons 23 is varied in its stroke. This results in variation of a displacement or compression capacity of the compressor. As described above, the internal pressure of the crank chamber 24 can be controlled by the pressure control valve 41.

While the present invention has thus far been described in conjunction with a single embodiment thereof, it will readily be possible for those skilled in the art to put this invention into practice in various other manners. For example, although the description has been directed to the swash-plate compressor of a variable-displacement type, this invention is also applicable to a fixed-displacement type.

What is claimed is:

1. A swash-plate compressor comprising:

a drive shaft;

a swash plate placed concentric with said drive shaft;

a support mechanism comprising a rotor means supported on said drive shaft so as to be unrotatable relative to said drive shaft and a bearing means rotatably supporting said swash plate on said rotor means, said supporting mechanism supporting said swash plate on said drive shaft so that said swash plate is rotatable relative to said drive shaft around a predetermined axis extending in a given direction;

a piston; and a connection mechanism connecting said piston to said swash plate, said connection mechanism comprising:

a drive end portion connected to said piston and having a concave surface defining a recessed portion;

a flat portion connected to said swash plate and loosely inserted in said recessed portion; and a sliding member held between said concave surface and said flat portion in said given direction to be slidable along said concave surface and said flat portion.

2. A swash-plate compressor as claimed in claim 1, wherein said flat portion has two parallel planes opposite to each other in said given direction, said sliding member comprising two shoes each of which is interposed between each of said parallel planes and said concave surface.

3. A swash-plate compressor as claimed in claim 2, wherein said concave surface is spherical, each of said shoes being in substantial contact with each of said parallel planes and said concave surface.

4. A swash-plate compressor as claimed in claim 2, wherein each of said shoes has a spherical surface and a flat surface which confront with said concave surface and with each of said parallel planes, respectively.

5. A swash-plate compressor as claimed in claim 1, wherein said swash plate has a peripheral surface circularly extending around said predetermined axis, said flat portion protruding outwardly from said peripheral surface to form a ring-shaped flange.

6. A swash-plate compressor as claimed in claim 1, wherein said rotor means has a hinge mechanism for varying an angle of said swash plate with respect to said drive shaft, said piston being variable in stroke in response to a variation of said angle.

7. A swash-plate compressor as claimed in claim 6, further comprising:

a crank chamber accommodating said swash plate and said hinge mechanism and having chamber pressure; and a cylinder block having a cylinder bore communicating with said crank chamber, said piston being slidably inserted into said cylinder bore, said inclination angle of the swash plate being related to said chamber pressure.

* * * * *